United States Patent [19]

Combier

[11] Patent Number: 4,854,352

[45] Date of Patent: Aug. 8, 1989

[54] TEXTILE FABRICS HAVING A PLURALITY OF WARP AND FILLING LAYERS AND ATTENDANT METHOD OF MAKING

[75] Inventor: Charles M. Combier, Aiken, S.C.

[73] Assignee: J. B. Martin Company, Leesville, S.C.

[21] Appl. No.: 202,943

[22] Filed: Jun. 6, 1988

Related U.S. Application Data

[63] Continuation-in-part of Ser. No. 12,062, Feb. 6, 1987, Pat. No. 4,748,996.

[51] Int. Cl.[4] ..... D03D 11/00

[52] U.S. Cl. ..... 139/408; 139/415; 139/420 R; 428/226

[58] Field of Search ..... 139/420 R, 420 G, 420 C, 139/408, 409, 410, 411, 412, 413, 414, 415, 383 A; 428/109, 226, 251, 252

[56] References Cited

U.S. PATENT DOCUMENTS

| | | | |
|---|---|---|---|
| 417 | 12/1856 | McNair . | |
| 279,042 | 6/1883 | Tarbox . | |
| 761,554 | 5/1904 | Stevenson . | |
| 975,940 | 11/1910 | Felterly | 139/408 |
| 2,893,442 | 7/1959 | Genin . | |
| 3,045,319 | 7/1962 | Scheel . | |
| 3,205,119 | 9/1965 | Paul | 139/415 |
| 3,434,508 | 3/1969 | Alterman et al. . | |
| 3,537,488 | 11/1970 | Le Boef | 139/415 |
| 3,819,461 | 6/1974 | Saffadi . | |
| 3,914,494 | 10/1975 | Park . | |
| 3,997,697 | 12/1976 | Brochier . | |
| 4,038,440 | 7/1977 | King . | |
| 4,055,697 | 10/1977 | Schmanski . | |
| 4,320,160 | 3/1982 | Nishimura et al. . | |
| 4,365,655 | 12/1982 | Feinberg . | |
| 4,460,633 | 7/1984 | Kobayashi et al. . | |
| 4,499,842 | 2/1985 | Mahr . | |
| 4,536,438 | 8/1985 | Bishop et al. . | |
| 4,569,883 | 2/1986 | Renjilian | 139/383 A |
| 4,581,275 | 4/1986 | Endo et al. . | |
| 4,729,860 | 3/1988 | Leach . | |
| 4,759,975 | 7/1988 | Sutherland et al. | 139/383 A |

*Primary Examiner*—Henry S. Jaudon

*Attorney, Agent, or Firm*—Bell, Seltzer, Park & Gibson

[57] ABSTRACT

A woven multilayered textile fabric and attendant method wherein a plurality of layers of the fabric are formed of straight yarns, including a plurality of layers formed of warp yarns and a plurality of layers formed of filling yarns positioned in superposed relation on opposite sides of the layers of warp yarns and extending at right angles to the warp yarns, and binder yarns arranged in cooperating pairs with one binder yarn of each pair extending over certain superposed filling yarns and under certain other superposed filling yarns, and the other binder yarn of each pair being woven oppositely under said certain superposed filling yarns and over said certain other superposed filling yarns.

7 Claims, 2 Drawing Sheets

TEXTILE FABRICS HAVING A PLURALITY OF WARP AND FILLING LAYERS AND ATTENDANT METHOD OF MAKING

This application is a continuation-in-part of copending application Ser. No. 012,062 filed Feb. 6, 1987 and entitled Woven Multilayered Textile Fabrics and Attendant Method of Making, now U.S. Pat. No. 4,748,996.

This application relates to woven textile fabrics of multilayered construction wherein the respective layers of the fabric are formed from groups of straight yarns, both warp and filling. The respective filling yarns of the layers are arranged in superposed relation with respective layers of straight warp yarns positioned between the layers of filling yarns. Cooperating pairs of binder yarns are provided for interconnecting all of the layers of fabric together and to maintain the filling yarns in their superposed relation.

This invention is an improvement over the parent application and teaches the making of multilayered fabrics of an increased number of layers, both in the warp and filling. This reduces the number of separate fabrics to be handled as when the layers are formed of carbon fibers and the fabrics are used as reinforcement fabrics in fiber reinforced plastics, commonly termed composites. Further, the reduced number of separate fabrics utilized in composites improves the shear strength of the reinforcing fabrics since there are a lesser number of layers of fabric which are not interconnected with each other.

It is a further feature of this invention to provide multilayer fabric constructions which even when matrix-free, i.e., free of any thermoplastic material, will readily conform to a variety of different shapes for facilitating the laying up of fabrics into a desired number of layers as in preforming, and in the molding of composites wherein the fabrics are employed as reinforcing media with plastic matrix material. This conformability of the fabrics is bidirectional, i.e., both warpwise and fillingwise, with the yarns of the fabrics essentially shifting and moving relative to each other to readily conform to the desired shape of the object against which the fabric is being placed.

It is a further feature of this invention to provide a novel method of weaving fabrics of this invention. Briefly stated, this method includes directing a plurality of groups of warp yarns for forming straight warp yarn layers into the shed of the loom while forming sheds of the groups of warp yarns. During weaving, layers of filling yarns will be positioned on opposite sides of the groups of warp yarns. For interconnecting the layers of filling yarns with the layers of straight warp yarns, binder warp yarns are fed from a source in a positive manner with the binder yarns also forming warp sheds during weaving. The positive feed for the binder yarns results in the binder yarns being under substantially no tension so as not to appreciably disturb the desired straight condition of the filling yarns.

BRIEF DESCRIPTION OF THE DRAWINGS

Some of the objects and advantages of this invention having been stated, others will appear when taken in connection with the accompanying drawings, wherein.

Figure 1:
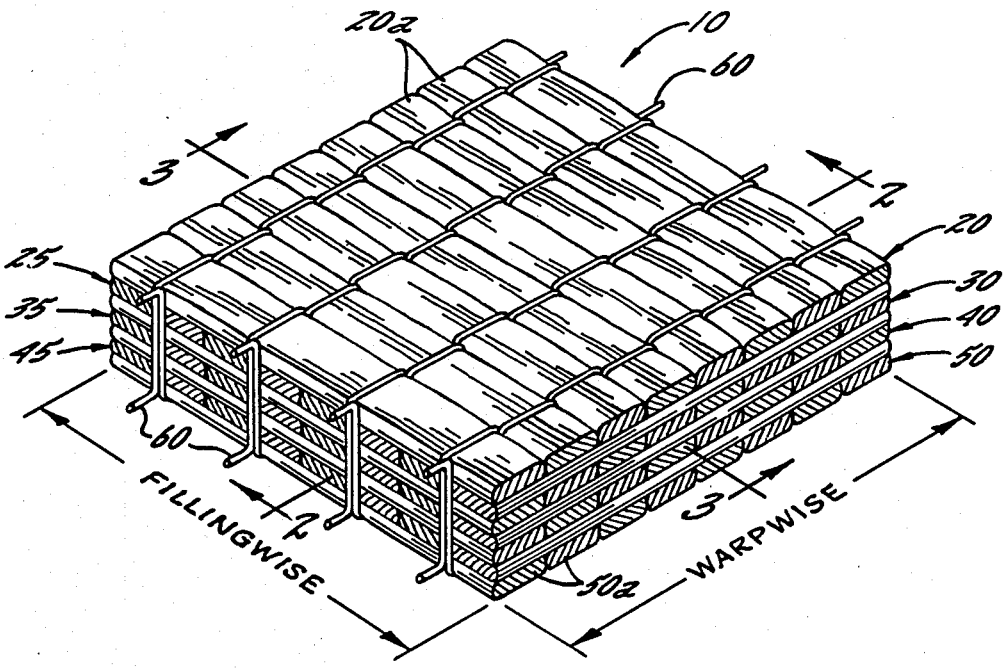
FIG. 1 is a schematic perspective view of a seven layered woven fabric formed in accordance with this invention.
Figure 2:
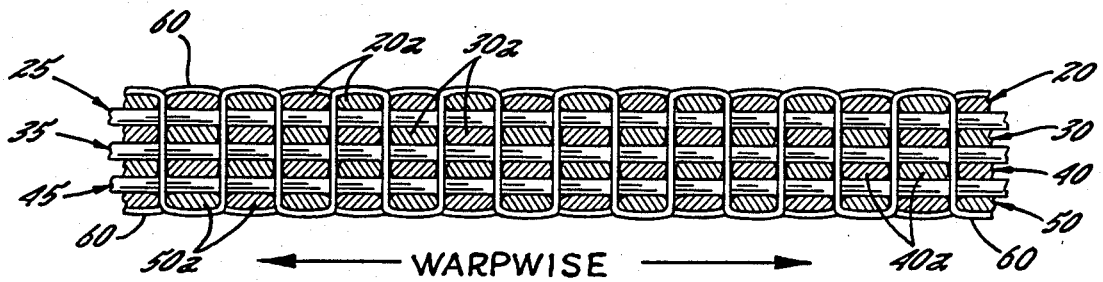
FIG. 2 is a schematic sectional view taken warpwise of the fabric along line 2—2 of FIG. 1.
Figure 3:
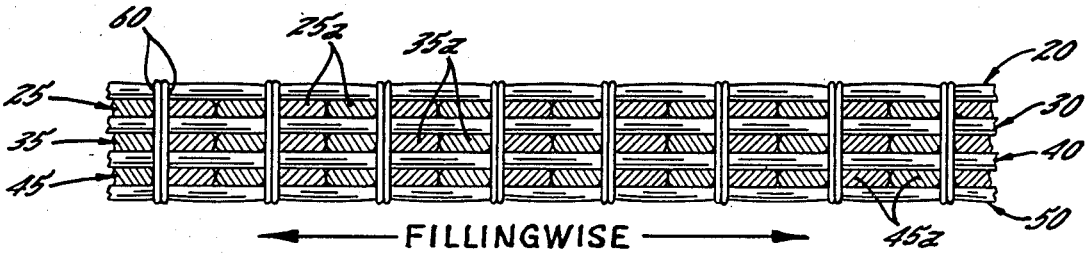
FIG. 3 is another schematic sectional view taken fillingwise of the fabric along line 3—3 of FIG. 1.

Referring not specifically to the drawings, FIGS. 1–3, schematically illustrate a typical multilayered fabric 10 formed in accordance with this invention. As illustrated, the fabric is shown as being of seven layer construction having four filling layers 20, 30, 40, and 50, and three warp layers 25, 35, and 45. Relatively small binder warp yarns 60, as illustrated, bind all seven layers together by being interwoven therewith.

As illustrated in FIGS. 1–3 it will be noted that the filling layers 20, 30, 40, and 50 are arranged in alternation and at right angles with respect to the three warp layers 25, 35, and 45. Further, it will be noted that each of these seven layers is formed of a group of yarns which have been designated with the suffix "a" added to the identifying layer number. Thus, the yarns for the respective four filling layers 20, 30, 40, and 50 have been respectively identified as yarns **20*a*, 30*a*, 40*a*, and 50*a*. Similarly, with respect to the three warp layers 25, 35, and 45, the groups of yarns making up these layers have respectively been identified as 25*a*, 35*a*, and 45*a*.**

As illustrated, the filling yarns **20*a*, 30*a*, 40*a* and 50*a* are arranged in superposed relationship and held in this relationship by the warp binder yarns 60. The warp binder yarns 60 are arranged in cooperating pairs, with the binder yarns of each pair preferably being close together to form a chain stitching type of plain weave construction (FIGS. 1 and 2) with one binder yarn of each pair extending over certain superposed filling yarns 20*a*, 30*a*, 40*a*, and 50*a* and under certain other superposed filling yarns. The other binder yarn of each pair is woven oppositely under said certain superposed filling yarns and over said certain other superposed filling yarns, as best illustrated in FIG. 2** of the drawings. By this arrangement, as noted earlier, the filling yarns are maintained in superposed relationship with each other to aid in providing the desired tightness and density of fabric construction and in facilitating obtaining certain types of balanced fabrics, when desired, which are preferred for certain end uses.

As best shown in FIG. 3 the warp yarns making up each of the warp layers 25, 35, and 45 are arranged in pairs with a cooperating pair of binder yarns 60 extending between each of the pairs of warp yarns **25*a*, 35*a*, and 45*a*. It will, of course be understood that instead of having a pair of warp yarns 25*a*, 35*a*, and 45*a* between adjacent binder yarns 60** a lesser or greater number of warp yarns may be arranged therebetween.

Figure 4:
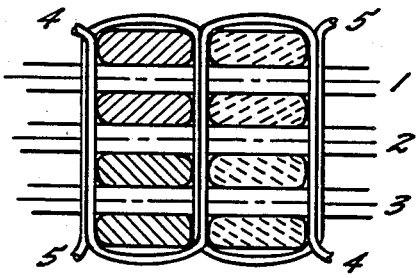
FIG. 4 is a schematic sectional view similar to FIG. 2 taken warpwise of the fabric and illustrating one repeat of the fabric.
Figure 5:
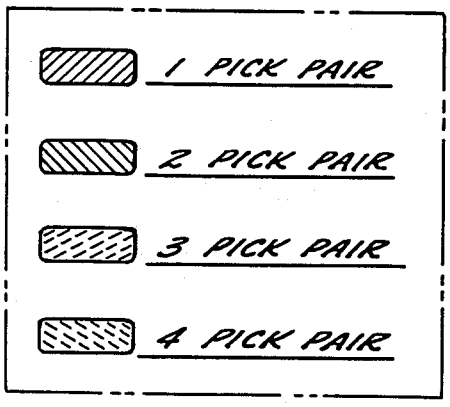
FIG. 5 is an identifying pick chart for aiding in understanding the repeat pattern of the fabric.

Referring now to the second sheet of drawings, description will now be given as to the weaving construction and the manner of weaving the disclosed seven layer fabric of this invention. FIG. 4 is essentially a repeat portion of the weave pattern such as shown in FIG. 2 schematically blown up with each of the pairs of filling yarns being cross patched in a different manner as indicated in FIG. 5 for more readily understanding the four pick repeat pattern of this seven layer weave construction. Still referring to FIG. 4 it will be noted that the respective layers of warp yarns 25, 35, and 45 are for simplicity herein designated 1, 2, and 3 respectively and the binder yarns 60 have been designated 4 and 5 respectively.

Figure 6:
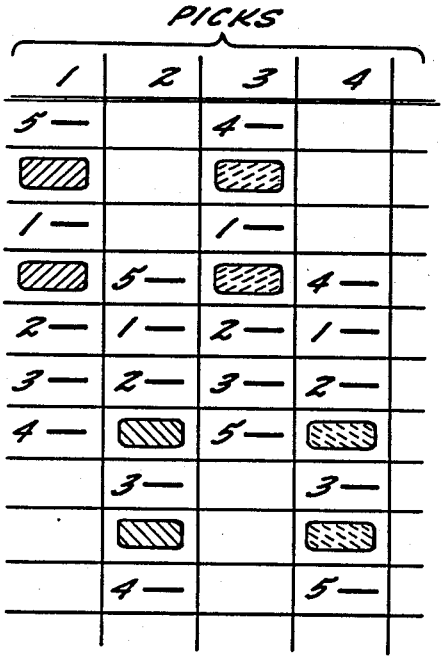
FIG. 6 is a chart illustrating the position of the warp and filling yarns during each of the four double picks of the repeat pattern of the fabric.

Referring now to FIG. 6 it will be noted that this chart encompasses the four picks for effecting a repeat pattern of the seven layer fabric. Bearing in mind that each pick is a double or pair of picks it will thus be noted from viewing this chart that the first and third picks are identical with each other with respect to the position of the warp yarns making up the layers of straight yarns and only the binder yarns designated 4 and 5 have been reversed from their position of the first pick. Similarly, comparing the second and fourth picks, these picks are identical with each other except for the reversal of the binder yarns 4 and 5 with respect to each other.

Figure 7:
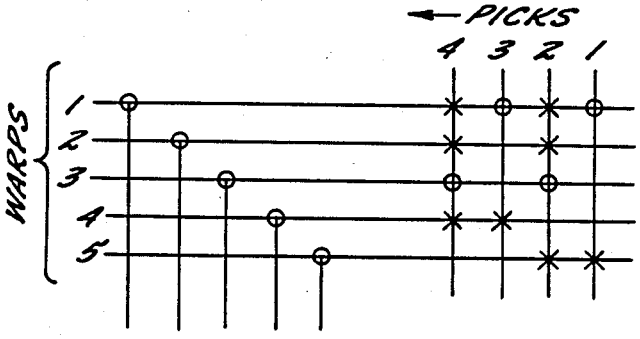
FIG. 7 is another weaving chart illustrating in a more conventional manner the position of the warp yarns for each of the four picks of the repeat pattern of the fabric.

Referring now to FIG. 7 wherein a somewhat more typical weave layout of the fabric pattern is disclosed, it should be understood for proper reading of FIG. 7 that the "x's" represent the raising of the particular identified warps and the absence of any "x's" designates that such warps are in the lowermost position. The small circles, one of which appears in each of the four picks represents the middle position of the warp yarns. For example, looking at the first pick as illustrated in FIG. 7 it will be noted that warp yarn number 1 is in the middle position which is readily apparent from FIG. 6 wherein it will be noted that warp yarn number 1 is between the upper and lower pair of double picks. It will further be noted with respect to the first pick as shown in FIG. 7 that only warp yarn 5 is raised so as to extend above the double pick of filling. Continuing with the explanation of FIG. 7, with respect to the second pick of fabric it will be noted that warp yarns 1, 2 and 5 have been designated as being raised and with the third warp yarn being at the middle or non-raised position and warp yarn 4 being in the lowered position. What has been related with respect to the first two picks of fabric will be more readily understood when viewing FIG. 6 and comparing the same with FIG. 7.

At this point it should be understood that in the weaving of this fabric the second pick of fabric when beat up positions the pair of filling yarns making up the second pick in superposed relationship with the first pair of picks, i.e. all four picks are arranged in superposed relationship as best illustrated in the schematic fabrics shown in FIGS. 1–4.

It will be noted upon a study of FIGS. 6 and 7 as indicated earlier, that the third pick is the same as the first pick except the binder yarns 4 and 5 have been crossed and are in reverse position. Similarly the fourth pick as compared to the second pick is identical except for the reversal and crossing of the binder warp yarns 4 and 5.

It should be understood that the beat ups occurring with respect to the second and fourth picks necessarily result in repositioning the filling yarns of the second and fourth pick in superposed relationship with the filling yarns making up the respective first and third picks. This occurs due to the weave pattern, i.e. the guiding action of the particular arrangement of all the warp yarns. A careful examination of FIG. 6 will aid in this understanding.

In order to maintain the filling yarns in their straight condition in the fabric, as disclosed in applicant's parent aforementioned application, the binder warp yarns 60 are fed in a substantially tensionless condition by a known positive drive apparatus through a series of feed rolls driven by the positive drive apparatus. Thus the positive drive apparatus presents the binder yarns forwardly in a substantially tensionless condition thereby avoiding any tension being placed on the binder yarns so as to ensure that the binder yarns do not disturb the straight line condition of the filling yarns 20*a*, 30*a*, 40*a*, and 50*a* forming the respective four filling layers 20, 30, 40, and 50 of the fabric. It will thus be understood that the binder yarns 60 maintain the superposed filling yarns in the stacked manner as illustrated in the drawings.

In accordance with the method of this invention, the seven layer fabric 10 is a four pick fabric formed of four filling layers and three warp layers and comprises the steps of simultaneously inserting a pair of picks of filling yarns to form two of the straight filling layers while positioning a layer of warp yarns therebetween and while positioning the two other remaining layers of warp yarns below both filling yarns. During this pick, the pair of binder yarns 60 are positioned to extend above and below the seven layers of fabric being woven, with the fabric being beaten up without changing the position of the binder yarns. A successive pair of picks is then positioned on opposite sides of a different layer of warp yarns, i.e. a different layer of warp yarns being therebetween as compared to the first pick. The two other remaining layers of warp yarns are positioned to extend above both filling yarns with the beating up of the fabric serving to position the last pair of picks of filling yarns underneath and in substantial vertical alignment with the earlier inserted pairs of picks of filling yarns. At this point after these two picks, the binder yarns 60 are reversed so that the binder yarns cross each other and the foregoing weaving steps for the next two picks i.e. the third and fourth pick of filling yarns proceeds in a similar manner as for the first two picks.

As indicated earlier, it will be understood that when strong yarns are utilized for forming all seven layers of the fabric, as illustrated in FIGS. 1 to 3, and relatively strong yarns are utilized for the binder yarns 60, that a very strong fabric is provided which is ideally adapted to be used as a reinforcement fabric in fiber reinforced plastics, which the trade commonly terms as composites. Fabrics made to date include constructions wherein all of the yarns forming the seven layers of the fabric are carbon, the carbon warp yarns being of 12K size and twice the size of filling yarns which were formed with 6K yarns. The binder yarns have typically been 0.005 monofilaments of a high temperature resistant thermoplastic yarn such as Peek yarn as well as 3K carbon yarns.

As indicated earlier, while shape retention is an important feature of this invention as in the parent application, where preforming is present, a more important feature of this invention is the ability of the fabric to conform to a desired shape so as to permit the fabric to stay where placed, particularly in the laying up of layers of fabric on each other on a desired shape mold, for example.

It is thus evident that a wide variety of fabrics may be made in accordance with this invention wherein all of the plurality of warp layers and all of the plurality of filling layers may be formed of yarns of the same type of fiber or wherein selected types of fibers may be utilized where desired as for example forming opposite faces of the fabric of different fibers for particular end uses. Also it will be understood that by having the plurality of warp and plurality of filling layers arranged in the manner as indicated, i.e. wherein the filling yarns are in superposed stacked relationship, that very strong and significantly unique fabrics are obtainable with this invention.

That which I claim is:

1. A woven multilayered readily moldable textile fabric having a plurality of yarn layers formed of straight warp yarns and a plurality of yarn layers formed of straight filling yarns arranged in alternation with said layers of straight warp yarns and wherein some of said filling yarn layers define opposite faces of the fabric, the respective filling yarns of said plurality of layers being in superposed relation and extending at right angles to the warp yarns, and relatively small binder warp yarns interconnecting the respective straight warp and filling yarns of said layers, the straight warp yarns in each layer being very close to each other and separated and spaced apart only by said relatively small binder yarns, said binder yarns also serving for maintaining said filling yarns in said superposed relation and being arranged in cooperating pairs with one binder yarn of each pair being woven in opposition to the other binder yarn of each pair so that one binder yarn extends over all of certain superposed filling yarns and under all of certain other superposed filling yarns and the other binder yarn of each pair extends under said certain superposed filling yarns and over said certain other superposed filling yarns.

2. A woven textile fabric according to claim 1 wherein said layers of filling yarns defining opposite faces of the fabric are formed of the same material so as to provide the same characteristics to opposite faces of the fabric.

3. A woven textile fabric according to claim 1 wherein all said layers of filling yarn are formed of carbon fibers and all said layers of warp yarns are also formed of carbon fibers so that the fabric is adapted to be used as a reinforcement fabric in fiber reinforced plastics.

4. A woven textile fabric according to claim 1 wherein all of said layers of warp yarns and all said layers of filling yarns are formed of carbon fibers, and said binder yarns are formed of non-carbon fibers and are of a much smaller cross-sectional size than said yarns formed of carbon fibers.

5. A woven multilayered readily moldable textile fabric having a plurality of yarn layers formed of straight warp yarns and a plurality of yarn layers formed of straight filling yarns arranged in alternation with said layers of straight warp yarns and wherein some of said filling yarn layers define opposite faces of the fabric, the respective filling yarns of said plurality of layers being in superposed relation and extending at right angles to the warp yarns, and relatively small binder warp yarns interconnecting the respective straight warp and filling yarns of said layers, the straight warp yarns in each layer being very close to each other and separated and spaced apart only by said relatively small binder yarns, said binder yarns also serving for maintaining said filling yarns in said superposed relation and being arranged in cooperating pairs with one binder yarn of each pair being woven in opposition to the other binder yarn of each pair so that one binder yarn extends over all of certain superposed filling yarns and under all of certain other superposed filling yarns and the other binder yarn of each pair extends under said certain superposed filling yarns and over said certain other superposed filling yarns and wherein the overall fabric construction is such that the fabric without any pretreatment or aftertreatment may be mutually pressed into intimate engagement with the surface of a variety of different configured objects and conform to the shape thereof and retain such shape after removal from such object so as to permit manual handling of the fabric as in preforming, without appreciably disturbing the conforming shape.

6. A woven multilayered readily moldable textile fabric having seven layers formed of straight yarns and comprising three yarn layers formed of straight warp yarns and four yarn layers- formed of straight filling yarns arranged in alternation with said layers of straight warp yarns and wherein two of said filling yarn layers respectively define opposite faces of the fabric, the respective filling yarns of said four layers being in superposed relation and extending at right angles to the warp yarns, and binder warp yarns interconnecting the respective straight warp and filling yarns of said seven layers, said binder yarns also serving for maintaining said filling yarns in said superposed relation and being arranged in cooperating pairs with one binder yarn of each pair being woven in opposition to the other binder yarn of each pair so that one binder yarn extends over certain superposed filling yarns and under certain other superposed filling yarns and the other binder yarn of each pair extends under said certain superposed filling yarns and over said certain other superposed filling yarns.

7. A method of weaving a seven layer fabric having four filling layers formed of groups of straight filling yarns and three warp layers formed of groups of straight warp yarns, with the seven layers of fabric held together by warp binder yarns, said method comprising the steps of providing three respective groups of warp yarns for forming the three warp layers of straight warp yarns, inserting a first pair of filling yarns so as to form two straight layers of filling yarns while having one of the groups of warp yarns positioned between the layers of filling yarns and while having the two other groups of warp yarns positioned to extend below both filling yarns, positioning a pair of binder yarns to extend respectively above and below the two straight layers of filling yarns, beating up the fabric without changing the position of the binder warp yarns relative to each other, inserting a second pair of filling yarns while having a different group of the warp yarns positioned therebetween and while having positioned the two other remaining groups of warp yarns to extend above the second pair of filling yarns, beating up the fabric to position the second pair of filling yarns underneath and in substantially vertical alignment with the first pair of filling yarns and while having the binder yarns positioned so as to continue to extend above and below the filling yarns, crossing the binder yarns to reverse the position thereof, and repeating the foregoing weaving steps for the next two pairs of inserted filling yarns to complete a repeat of the weaving operation.

* * * * *

UNITED STATES PATENT AND TRADEMARK OFFICE

CERTIFICATE OF CORRECTION

PATENT NO. : 4,854,352

DATED : August 8, 1989

INVENTOR(S) : Charles Combier

It is certified that error appears in the above-identified patent and that said Letters Patent is hereby corrected as shown below:

IN THE CLAIMS:

Column 6, line 9, delete "mutually" and insert --manually--.

Column 6, line 19, delete "layers-" and insert --layers--.

Signed and Sealed this

Twenty-seventh Day of March, 1990

*Attest:*

JEFFREY M. SAMUELS

*Attesting Officer*

*Acting Commissioner of Patents and Trademarks*